US007288001B1

(12) United States Patent
Aekins

(10) Patent No.: US 7,288,001 B1
(45) Date of Patent: Oct. 30, 2007

(54) ELECTRICALLY ISOLATED SHIELDED MULTIPORT CONNECTOR ASSEMBLY

(75) Inventor: Robert A. Aekins, Quaker Hill, CT (US)

(73) Assignee: Ortronics, Inc., New London, CT (US)

( * ) Notice: Subject to any disclaimer, the term of this patent is extended or adjusted under 35 U.S.C. 154(b) by 0 days.

(21) Appl. No.: 11/524,094

(22) Filed: Sep. 20, 2006

(51) Int. Cl.
*H01R 13/66* (2006.01)

(52) U.S. Cl. ..... 439/540.1

(58) Field of Classification Search ..... 439/540.1, 439/676, 417

See application file for complete search history.

(56) References Cited

U.S. PATENT DOCUMENTS

| | | | | |
|---|---|---|---|---|
| 2,714,194 | A | 7/1955 | Beynink | |
| 4,211,462 | A | 7/1980 | Wolfthal | |
| 5,046,967 | A | 9/1991 | Majernik et al. | |
| 5,059,140 | A | 10/1991 | Philippson et al. | |
| 5,106,325 | A * | 4/1992 | Robinson et al. | 439/540.1 |
| 5,186,647 | A | 2/1993 | Denkmann et al. | |
| 5,269,708 | A | 12/1993 | DeYoung et al. | |
| 5,281,170 | A | 1/1994 | Murphy | |
| 5,299,956 | A | 4/1994 | Brownell et al. | |
| 5,310,363 | A | 5/1994 | Brownell et al. | |
| 5,326,284 | A | 7/1994 | Bohbot et al. | |
| 5,341,419 | A | 8/1994 | Ferry | |
| 5,350,324 | A | 9/1994 | Guilbert | |
| 5,362,257 | A | 11/1994 | Neal et al. | |
| 5,399,107 | A | 3/1995 | Gentry et al. | |
| 5,414,393 | A | 5/1995 | Rose et al. | |
| 5,432,484 | A | 7/1995 | Klas et al. | |
| 5,503,572 | A | 4/1996 | White et al. | |
| 5,513,065 | A | 4/1996 | Caveney et al. | |
| 5,547,405 | A | 8/1996 | Pinney et al. | |
| 5,586,914 | A | 12/1996 | Foster, Jr., et al. | |
| 5,599,209 | A | 2/1997 | Belopolsky | |
| 5,618,185 | A | 4/1997 | Aekins | |
| 5,628,653 | A | 5/1997 | Haas et al. | |
| 5,639,266 | A | 6/1997 | Patel | |
| 5,647,770 | A | 7/1997 | Belopolsky | |
| 5,674,093 | A | 10/1997 | Vaden | |
| 5,687,478 | A | 11/1997 | Belopolsky | |
| 5,697,817 | A | 12/1997 | Bouchan et al. | |
| 5,759,070 | A | 6/1998 | Belopolsky | |
| 5,779,503 | A | 7/1998 | Tremblay et al. | |
| 5,797,764 | A | 8/1998 | Coulombe et al. | |
| 5,830,005 | A | 11/1998 | Watanabe | |

(Continued)

FOREIGN PATENT DOCUMENTS

| | | |
|---|---|---|
| EP | 0 674 364 A1 | 9/1995 |

(Continued)

*Primary Examiner*—Tulsidas C. Patel
*Assistant Examiner*—Harshad C Patel
(74) *Attorney, Agent, or Firm*—McCarter & English, LLP

(57) ABSTRACT

The present disclosure relates to a multiport connector assembly for a telecommunication connector system that is designed to reduce crosstalk noise between adjacent ports by electrical isolation design. The reduction of noise is done by non-conventional methods of connecting hardware shielding techniques. The shield design consists of enclosing alternating modular inserts of a port with a metalized modular housing to reduce the transmitted signals electromagnetic radiation during transmission. Each port within the multiport assembly will typically have a single PCB, a corresponding IDC pin group and a modular insert. The PCB's are typically arranged in a staggered formation within a front housing.

30 Claims, 4 Drawing Sheets

U.S. PATENT DOCUMENTS 5,864,089 A 1/1999 Rainal
5,911,602 A 6/1999 Vaden
5,913,702 A 6/1999 Garcin
5,931,703 A 8/1999 Aekins
5,938,479 A 8/1999 Paulson et al.
5,997,358 A 12/1999 Adriaenssens et al.
6,023,200 A 2/2000 Rhee
6,033,259 A * 3/2000 Daoud ..... 439/573
6,086,428 A 7/2000 Pharney et al.
6,089,923 A 7/2000 Phommachanh
6,113,418 A 9/2000 Kjeldahl
6,116,943 A 9/2000 Ferrill et al.
6,120,329 A 9/2000 Steinman
6,155,881 A 12/2000 Arnett et al.
6,168,474 B1 * 1/2001 German et al. ..... 439/676
6,183,306 B1 2/2001 Caveney
6,186,834 B1 2/2001 Arnett et al.
6,231,397 B1 5/2001 De la Borbolla et al.
6,290,546 B1 9/2001 Pharney
6,302,741 B1 10/2001 Fasold et al.
6,319,048 B1 11/2001 Aekins et al.
6,346,010 B1 2/2002 Emplit
6,361,354 B1 3/2002 Viklund et al.
6,371,793 B1 * 4/2002 Doorhy et al. ..... 439/404
6,394,844 B1 5/2002 Frias Valero et al.
6,443,777 B1 9/2002 McCurdy et al.
6,504,726 B1 * 1/2003 Grabinger et al. ..... 361/796
6,524,131 B2 2/2003 Schmidt et al.
6,533,618 B1 3/2003 Aekins
6,608,764 B2 * 8/2003 Clark et al. ..... 361/796
6,611,943 B2 9/2003 Ferrill et al.
6,729,899 B2 5/2004 Aekins et al.
6,736,670 B2 * 5/2004 Clark et al. ..... 439/540.1
6,743,047 B2 * 6/2004 Korsunsky et al. ..... 439/540.1
6,761,585 B2 * 7/2004 Clark et al. ..... 439/540.1
6,767,241 B1 * 7/2004 Abel et al. ..... 439/417
6,769,937 B1 * 8/2004 Roberts ..... 439/676
6,729,901 B2 10/2004 Aekins et al.
6,802,743 B2 10/2004 Aekins et al.
6,840,816 B2 1/2005 Aekins
6,848,943 B2 2/2005 Machado et al.
6,893,296 B2 5/2005 Aekins et al.
6,896,557 B2 5/2005 Aekins et al.
6,962,503 B2 11/2005 Aekins
7,037,140 B2 5/2006 Aekins et al.
7,112,090 B2 * 9/2006 Caveney et al. ..... 439/540.1
2002/0151208 A1 10/2002 Aekins
2003/0095395 A1 5/2003 Clark et al.
2005/0095920 A1 5/2005 Aekins et al.
2005/0151208 A1 7/2005 Uno et al.

FOREIGN PATENT DOCUMENTS

EP 0 955 703 A2 11/1999
EP 0 955 703 A3 11/2001

* cited by examiner

ELECTRICALLY ISOLATED SHIELDED MULTIPORT CONNECTOR ASSEMBLY

BACKGROUND

1. Technical Field

The present disclosure is directed to multiport connector assemblies for a telecommunication connector system that are designed to reduce crosstalk noise between adjacent ports through advantageous electrical isolation design(s).

2. Background Art

As Unshielded Twisted Pair ("UTP") cabling continues to be an essential choice of media transmission, new and improved methods must be employed meet the requirements of the transmitting data source. UTP cable is a popular and widely used type of data transfer media. UTP cable is a very flexible, low cost media, and can be used for either voice or data communications. In fact, UTP cable is in some respects the de facto standard for Local Area Networks (LANs), and other in-building voice and data communications applications. In an UTP, a pair of copper wires generally forms the twisted pair. For example, a pair of copper wires with diameters of 0.4-0.8 mm may be twisted together and wrapped with a plastic coating to form an UTP. The twisting of the wires increases the noise immunity and reduces the bit error rate (BER) of the data transmission to some degree. In addition, using two wires, rather than one, to carry each signal permits differential signaling to be utilized. Differential signaling is generally immune to the effects of external electrical noise.

The non-use of cable shielding (e.g., a foil or braided metallic covering) in fabricating UTP cable generally increases the effects of outside interference, but also results in reduced cost, size, and installation time of the cable and associated connectors. Additionally, non-use of cable shielding in UTP fabrication generally eliminates the possibility of ground loops (i.e., current flowing in the shield because of the ground voltage at each end of the cable not being the same). Ground loops may give rise to a current that induces interference within the cable, interference against which the shield was intended to protect.

The wide acceptance and use of UTP cable for data and voice transmission is primarily due to the large installed base, low cost and ease of new installation. Another important feature of UTP is that it is used for varied applications, such as for Ethernet, Token Ring, ATM, EIA-232, DSL, analog telephone (POTS), and other types of communication. This flexibility allows the same type of cable/system components (such as data jacks, plugs, cross-patch panels, and patch cables) to be used for an entire building, unlike shielded twisted pair media (STP). At present, UTP cabling is being utilized for systems having increasingly higher data rates. Since demands on networks using UTP systems (e.g., 100 Mbit/s and 1000 Mbit/s transmission rates) have increased, it has become necessary to develop industry standards for higher system bandwidth performance.

UTP systems such as 100 Mbit/s and 1000 Mbit/s transmission rates have produced requirements and specification for cabling transmission such as TIA 568B.2-1, which is basically the standard for category 6 cabling systems. The bandwidth requirements are 1 to 250 MHz. The main parameters are near-end crosstalk (NEXT), far-end crosstalk (FEXT), equal level FEXT, return loss (RL), attenuation, as well as, crosstalk Powersum parameters (PSNEXT) and PSELFEXT. From these parameters, one of the major contributors to system performance is control of NEXT. What began as the need for connecting hardware to provide NEXT loss of less than −36 dB at 16 MHz, has evolved to −54 dB at 100 MHz and −46 dB at 250 MHz for category 6 systems with future requirements up to 500 MHz. For any data transmission event, a received signal will consist of a transmission signal modified by various distortions. The distortions are added by the transmission system, along with additional unwanted signals that are inserted somewhere between transmission and reception. The unwanted signals are referred to as noise. Noise is the major limiting factor in the performance of today's communication systems. Problems that arise from noise include data errors, system malfunctions, and loss of the desired signals.

Generally, crosstalk noise occurs when a signal from one source is coupled to another line. Crosstalk noise could also be classified as electromagnetic interference (EMI). EMI occurs through the radiation of electromagnetic energy. Electromagnetic energy waves can be derived by Maxwell's wave equations. These equations are basically defined using two components: electric and magnetic fields. In unbounded free space, a sinusoidal disturbance propagates as a transverse electromagnetic wave. This means that the electric field vectors are perpendicular to the magnetic field vectors that lie in a plane perpendicular to the direction of the wave. NEXT noise is the effect of near-field capacitive (electrostatic) and inductive (magnetic) coupling between source and victim electrical transmissions.

Typical Category 5e, 6 and most likely C6 augmented connecting hardware will incorporate signal feedback techniques called compensation reactance. The use of compensation can decrease the internal noise associated with NEXT and FEXT, but it can also increase the connecting hardware external noise sources called alien near-end crosstalk (ANEXT) and alien far-end crosstalk (AFEXT), and the power summation of these noises.

ANEXT is near-end crosstalk noise that couples from one cabling media to an adjacent cabling media, measured at the near-end or transmitter. AFEXT is far-end crosstalk noise that couples from one cabling media to an adjacent cabling media, measured at the far-end or receiver. Power sum alien near-end crosstalk (PSANEXT) loss is a combination of signal coupling from multiple near-end disturbing cabling pairs into a disturbed pair of a neighboring cabling or part thereof, measured at the near-end. Power sum alien far-end crosstalk (PSAFEXT) loss is a combination of signal coupling from multiple far-end disturbing cabling pairs into a disturbed pair of a neighboring cabling or part thereof, measured at the far-end. IEEE 802.3 an 10 Gigabit Ethernet (10 Gbe) and the TIA TR42.7 working groups have identified ANEXT and AFEXT as major noise problems that can effect proper 10 Gbe operation over UTP cabling systems, with ANEXT being the most impactful of the two. The initial ANEXT requirement for UTP cabling system, also called "Augmented Category 6 UTP," is shown in Table 1 below:

TABLE 1

ANEXT from TIA 568B.2-A10 draft for Augmented Category 6 (100 meters channel link cabling)

| MHz | dB |
|---|---|
| 10 | −70 |
| 100 | −60 |
| 250 | −54 |
| 400 | −51 |
| 500 | −49.5 |

Connecting hardware systems that will run 10 Gbe data signals must be designed to meet traditional Category 6, as well as recognized additional 10 Gbe UTP cabling parameters. Due to the adjacency of connecting hardware in a cabling system, ANEXT and AFEXT noise sources will necessarily be present.

One approach to control ANEXT is the usage of a fully shielded cabling system, also called Foiled Twisted pair or Screened Twisted pair (ScTP). Typical FTP cabling system incorporates metallic shields that are electrically mated to ground by the transmitting source and/or by the equipment rack ground system. The connector shields are electrically connected together, either externally by mated shield contact or internally by the PCB connection. FTP systems are an effective media for reduction of ANEXT and AFEXT noise sources. Other methods for reducing ANEXT and AFEXT involve mitigation techniques, such as increasing connector spacing arrangement. Utilizing FTP or mitigation cabling methods provide various issues and increase complexities. In addition, FTP systems are considerably more expensive in material and installation cost. As previously discussed, another issue with FTP is proper installation of system grounds. Poor system grounding can create unwanted ground loops that could lead to increased system noise internally to the transmitter. Mitigation of connectors in many cases is not an option since standard wall outlets (i.e., single gang electrical boxes) and 1 rack unit (typ. 1.5 inch) high mount panels are spaced limited based on prior standards.

SUMMARY OF THE INVENTION

The present disclosure describes a multiport connector assembly having: (a) a plurality of PCB sub-assemblies, each sub assembly including: (i) at least one printed circuit board (PCB); (ii) a plurality of insulation displacement contact (IDC) pin groups having a plurality of IDC pins; and (iii) a modular insert; (b) a front housing; (c) a rear IDC housing having a plurality of IDC pin receptacles; and (d) a plurality of metalized modular housings, wherein each modular housing encloses a non-adjacent modular insert. Typically, each of the plurality of modular inserts is in electrical communication with the PCB and one of the plurality of IDC pin groups. The modular insert is adapted to receive a telecommunication connector plug, such as a RJ plug.

In an exemplary embodiment, the front housing defines a plurality of apertures wherein each aperture is adapted to receive one of the plurality of modular inserts and allow for insertion of the telecommunication connector plug. Each aperture is generally sized to receive a selected telecommunication plug, such as a RJ-45 plug. The front housing is typically made of plastic. A metalized modular housing is typically formed of metal or plastic that is coated (in whole or in part) in metal. An assembly associated with the present disclosure further includes an IDC pin shield coupled to the IDC pin groups. Typically, the IDC pin shield is selectively metalized.

According to an exemplary assembly according to the present disclosure, alternating modular inserts are enclosed with a metalized modular housing such that every other modular insert is enclosed within a metalized modular housing and each modular insert is electrically isolated from an adjacent modular insert. In such exemplary embodiment, the front housing is adapted to receive the alternatingly configured modular housings.

An exemplary multiport connector assembly associated with the present disclosure includes: (a) a plurality of PCB sub-assemblies, wherein each sub-assembly includes: a PCB, an IDC pin group having a plurality of IDC pins, and a modular insert; (b) a front housing; (c) a rear IDC housing having a plurality of IDC pin receptacles; and (d) a plurality of metalized modular housings, wherein each modular housing encloses a non-adjacent modular insert. The exemplary front housing defines a plurality of apertures, wherein each aperture is adapted to receive one of the plurality of the PCB sub-assemblies and allow for insertion of a telecommunication connector plug. The metalized modular housings are typically formed of metal or plastic plated (in whole or in part) with metal. Each modular housing encloses one modular insert in an alternating configuration such that every other modular insert is enclosed within a modular housing and each modular insert is electrically isolated from an adjacent modular insert.

In an exemplary embodiment, an assembly associated with the present disclosure includes the PCB sub-assemblies being arranged in a staggered configuration such that the modular inserts of each sub-assembly line-up substantially horizontally. In a further exemplary embodiment, the PCB sub-assemblies are arranged in a stacked configuration such that a first modular insert is directly above a second modular insert.

The present disclosure further relates to a method of reducing crosstalk noise within a multiport connector assembly by: (a) providing a plurality of PCB sub-assemblies, wherein each sub-assembly includes a PCB, an IDC pin group and a modular insert; (b) enclosing non-adjacent modular inserts with a metalized modular insert housing; and (c) enclosing the plurality of sub-assemblies and metalized modular insert housings within a front housing and a rear IDC pin housing. Enclosing the modular inserts with a modular insert housing electrically isolates one modular insert from an adjacent modular insert.

Further aspects, implementations, and advantages of the present invention will become more readily apparent from the description of the drawings and the detailed description of exemplary embodiments of the invention as provided herein below.

BRIEF DESCRIPTION OF THE DRAWINGS

So that those having ordinary skill in the art to which the disclosed invention appertains will more readily understand how to make and use the same, reference may be made to the drawings wherein.

DETAILED DESCRIPTION OF EXEMPLARY EMBODIMENT(S)

Figure 1:
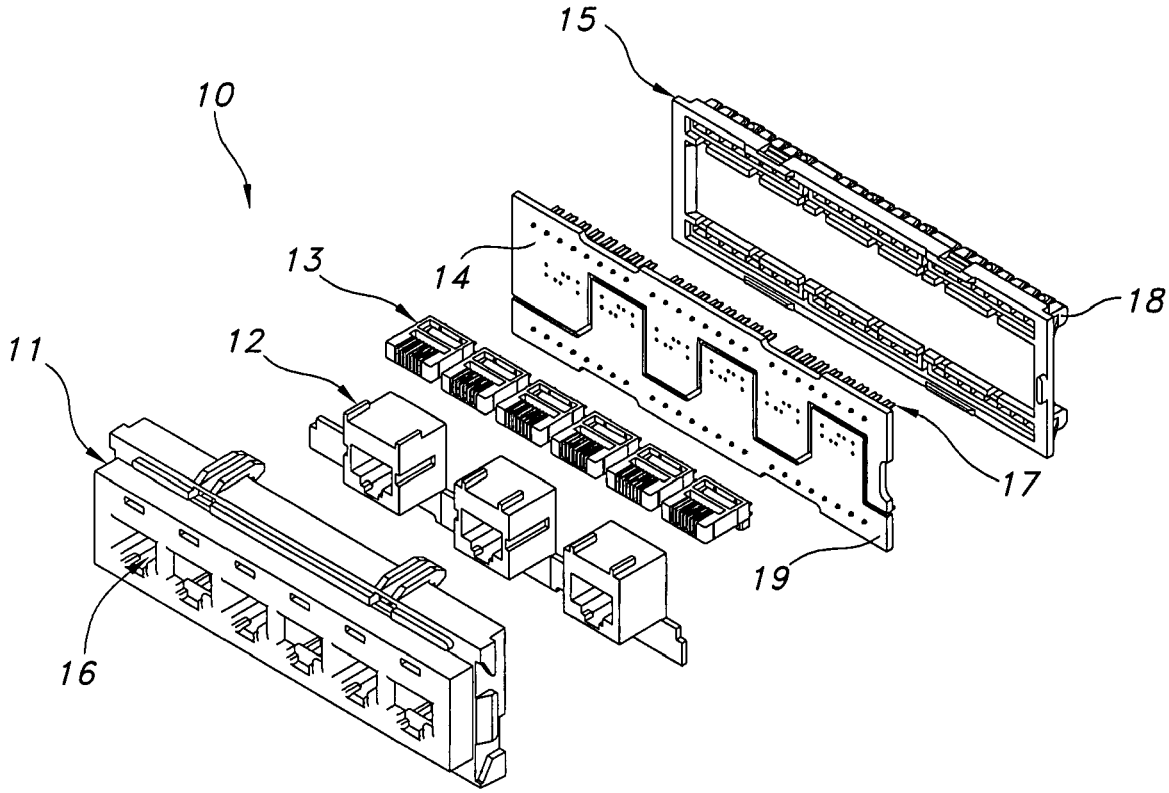
FIG. 1 is an exploded view of an exemplary assembly associated with the present disclosure.

The present disclosure describes a multiport connector assembly that is effective in reducing crosstalk noise associated with electronic signal transmission. Referring to FIG. 1, an exemplary embodiment of a multiport assembly 10 associated with the present disclosure is shown in an exploded view to more clearly illustrate the components of assembly 10. Assembly 10 includes a front housing 11 and a rear insulation displacement contact (IDC) housing 15. Sandwiched between front housing 11 and rear housing 15 are alternating modular housings 12, a plurality of modular inserts 13 and a plurality of printed circuit boards (PCB's). Front housing 11 defines a plurality of apertures 16, each of which is adapted to receive a telecommunication connector, e.g., an RJ-45 connector or a fiber optic connector (not shown). FIG. 1 illustrates an assembly 10 having two PCB's 14 and 19. PCB 14 and PCB 19 each have cooperating geometries to fit together such that modular inserts 13 substantially align horizontally.

Rear IDC housing 15 is adapted to (i) house IDC pins 17 associated with the PCB's; and (ii) allow for appropriate wiring to establish communication with the front side telecommunication connector. In an exemplary embodiment, front housing 11 can be made of engineering plastics, such as a copolymer of Acrylonitrile, Butadiene, and Styrene (ABS). ABS plastics generally possess industrially acceptable strength and performance at a reasonable cost that can be color coded to the customer's selection.

In an exemplary embodiment, an assembly 10 includes a single PCB 14 having a plurality of modular inserts 13 and a plurality of IDC pins 17, wherein IDC pins 17 are a group of eight IDC pins and each group corresponds to a single modular insert 13. In an alternative embodiment, an assembly 10 includes plurality of PCB's, e.g., two PCB's (shown in FIG. 1) or six PCB's (shown in FIG. 5), wherein each PCB includes at least one modular insert 13.

Typically, in a multi-PCB embodiment, each PCB 14 hosts at least one modular insert 13. Modular insert 13 extends away from PCB 14 towards the housing 11. In an exemplary embodiment, each of modular inserts 13 has a plurality of channel guides for receiving contacts of a telecommunication connector. Modular insert 13 typically contains terminals having eight lead frames in accordance with most standard wiring formations, such as the T568B and T568A style RJ-45 connectors. It is understood that assembly 10 can be sized and configured to receive any type of RJ plug. Each modular insert 14 is in electrical communication with at least one PCB 14 and is also mounted to PCB 14. PCB 14 includes a plurality of IDC pins 17 that extend from a rear face (not shown) of PCB 14 towards rear IDC housing 15. Rear housing 15 receives pins 17 in a plurality of IDC receptacles 18. Rear housing 15 is typically made from a polycarbonate or other like material.

It is common in the industry to design a PCB 14 having a plurality of IDC pins 17 to be substantially aligned horizontally. For example, in a multiport assembly such as assembly 10, IDC pins 17 associated with the first of the plurality of PCB's 14 will be substantially horizontally aligned on a top portion of PCB 14. Adjacent PCB's 14 will alternate IDC pin positions from the top portion to the bottom portion. Thus, in a six port assembly, ports one, three and five may be associated with IDC pins 17 aligned on the top portion of each respective PCB 14 and ports two, four, and six will be associated with IDC pins 17 aligned on the bottom portion of each respective PCB 14.

Assembly 10 includes a plurality of modular housings 12 arranged in an alternating configuration. Each modular housing 12 is adapted to receive a modular insert 13. In an exemplary embodiment of assembly 10, only every other modular insert 13 is enclosed by a modular housing 12. Thus, typically modular housings 12 are configured in an alternating manner. For example, as shown in FIG. 1, an assembly 10 having six ports will have six modular inserts 13, each associated with one of the plurality of PCB's 17. Modular inserts 13 will be typically horizontally aligned as commonly found in industry use. A modular housing 12 will enclose a modular insert 13. Adjacent modular inserts 13 will not be enclosed. Particularly, as shown in FIG. 1, a first modular housing 12 will receive the second of the six modular inserts 13, a second modular housing 12 will receive the fourth of the six modular inserts 13, and a third modular housing 12 will receive the sixth of the six modular inserts 13. It is noted that assembly 10 can have a plurality of ports and thus a plurality of modular inserts 13, wherein a separate and distinct modular housing 12 surrounds each alternating modular insert. The use of six ports is for illustrative purposes and is not intended to limit the present disclosure to such embodiments. Accordingly, alternative embodiments, e.g., eight or ten ports, are within the scope of the present disclosure.

Figure 2:
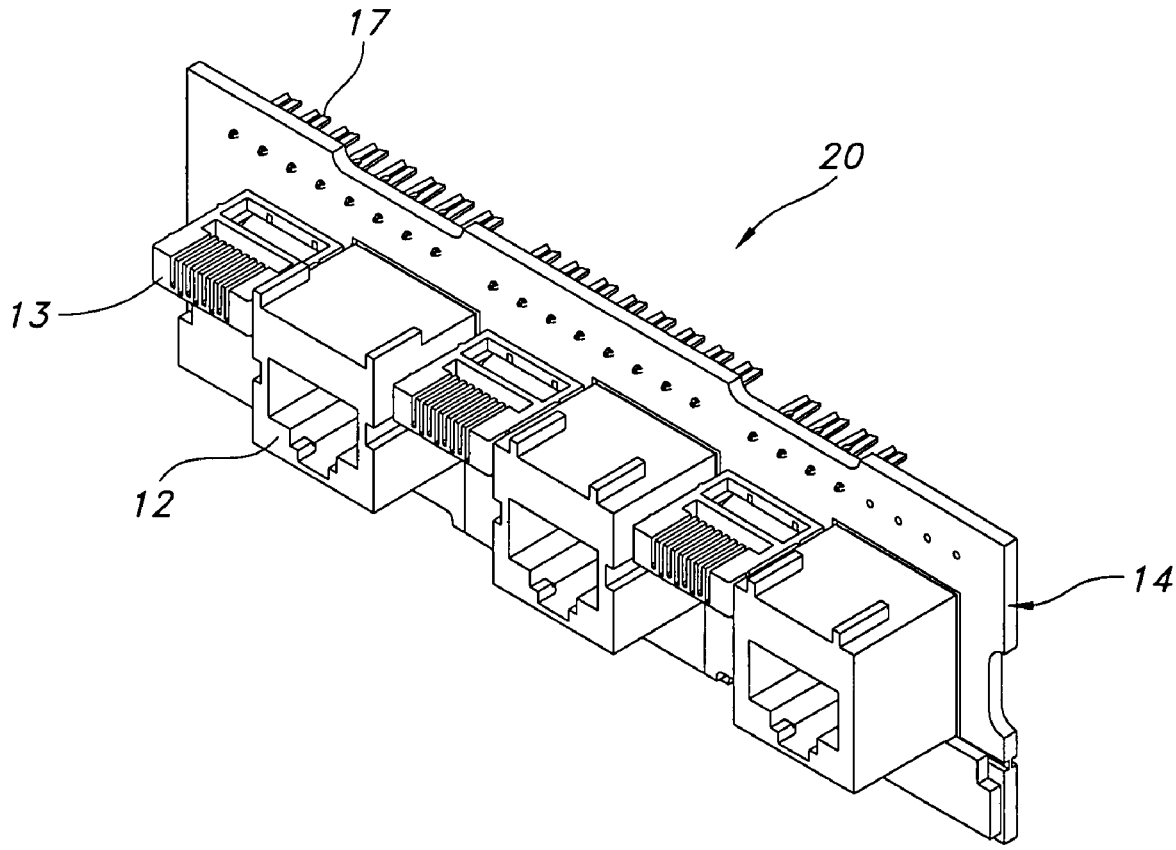
FIG. 2 is a front side perspective view of an exemplary sub-assembly associated with the present disclosure.

Referring to FIG. 2, a sub-assembly 20 of assembly 10 is shown. FIG. 2 illustrates an assembled embodiment of the PCB's 14 connected to modular inserts 13 and modular housings 12. In an exemplary embodiment, as described above, sub-assembly 20 includes three modular housings 12 arranged in an alternating manner, each enclosing an alternative modular insert 13. Each modular insert 12 is electrically connected to a separate PCB 14 and each PCB 14 includes a plurality of IDC pins 17 extending on a rear face of each of PCB 14.

Figure 3:
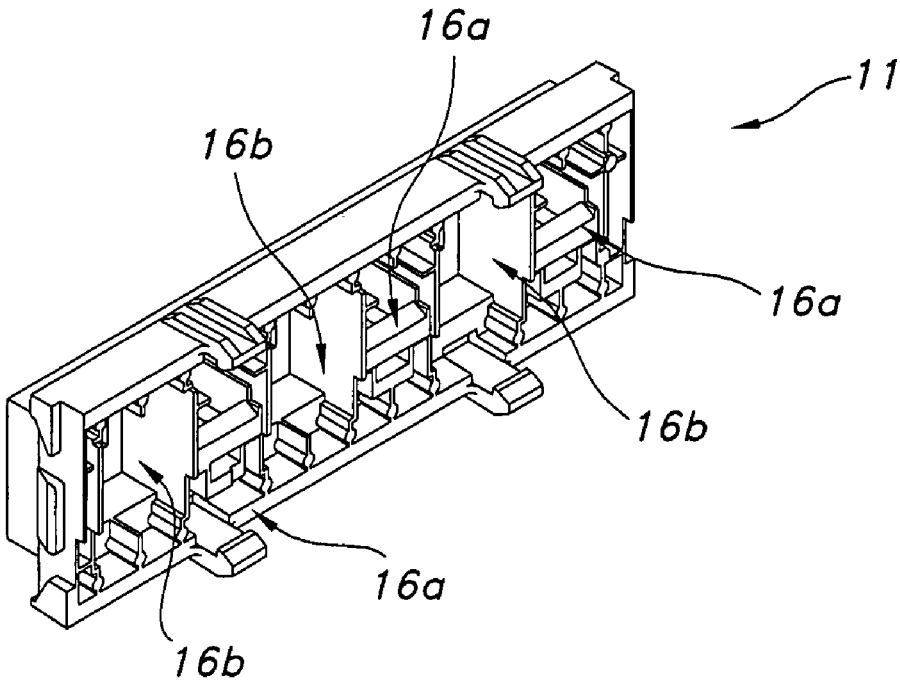
FIG. 3 is a rear side perspective view of an exemplary front housing associated with the present disclosure.

FIG. 3 illustrates a rear view of an exemplary front housing 11 defining six apertures 16. Housing 11 is adapted to receive sub-assembly 20 having the alternating modular housing configuration. In an exemplary embodiment, housing 11 defines six apertures 16 wherein: (i) alternating apertures 16(*a*) are adapted to receive the first, third and fifth of the six modular inserts 13 as shown in FIG. 2; and (ii) alternating apertures 16(*b*) are adapted to receive the second, fourth, and sixth of the six modular inserts 13, each of which is surrounded by a housing 12 as shown in FIG. 2. Front housing 11 is typically made of an industrially acceptable plastic.

Figure 4:
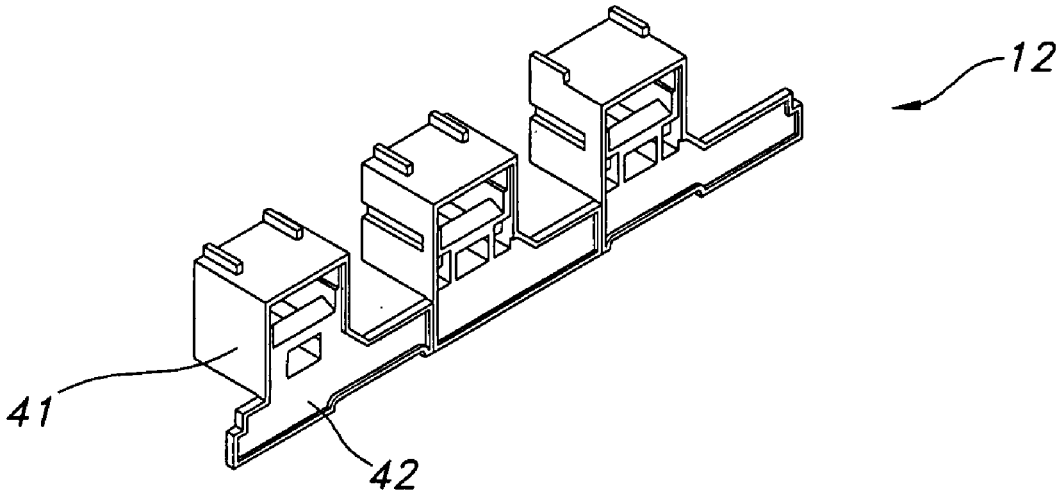
FIG. 4 is a rear side perspective view of exemplary alternate modular housings associated with the present disclosure.

FIG. 4 illustrates a rear side view of three exemplary modular housings standing alone, each adapted to receive and substantially enclose alternating modular inserts 13 of FIG. 1. In an exemplary embodiment, each modular housing 12 is metalized. Metalizing housing 12 essentially electrically isolates each modular insert 13 and respective IDC pins 17. Electrically isolating each modular insert 13 and respective IDC pins effectively reduces port-to-port crosstalk noise. Each housing 12 is floating relative to ground and electrically isolated from the electrical components of assembly 10. In exemplary embodiments of the present disclosure, metalizing housing 12 entails that housing 12 is die-cast or formed of metal. Alternative metalizing techniques may be employed without departing from the present disclosure. In addition, housing 12 can be formed of plastic, such as an ABS polymer, and the plastic may be plated (in whole or in part) with metal, such as having a copper under flash and nickel coating. In an exemplary embodiment, housing 12 may be fabricated with metalized injective plastic materials.

Each exemplary housing 12 includes a main body 41 attached to an extending feature 42. Main body 41 is adapted to enclose a modular insert 13. Extending feature 42 is adapted to provide metallic isolation to IDC pins 17 associated with the enclosed modular insert 13. Each housing 12 is formed as a single component and is made to fit securely into a front housing 11 and adapted to receive a telecommunication plug.

Typically, all sides of housing 12 are metalized. By metalizing housing 12, each modular insert 13 and respective IDC pins 17 are essentially electrically insulated from adjacent modular inserts 13 and respective ID pins 17. Thus, alien crosstalk is reduced from one port to an adjacent port. In addition, it is understood that the metalized housing is not meant to be a conductive path from a shield in an FTP cable; instead, metalized housings 12 function as floating shields and are adapted to not conduct electricity. Housing 12 is floating relative to ground, thereby preventing assembly 10 from grounding out during operation. Moreover, each port of assembly 10 is isolated from adjacent ports, thereby reducing crosstalk noise. Housing 12 can be metallic plated plastic, metallic injected plastic or all metal material.

In an exemplary embodiment, each port of assembly 10 operates as follows. A plug (not shown), which is attached to a cable (not shown), is inserted into aperture 16 of front housing 11. The contacts of the plug mate with the contacts of modular insert 13. A signal from the cable is transmitted through the plug and modular inserts 13 into PCB 14. The signal is transferred from the PCB 14 to IDC pins 17, which is connected to a second cable, thus completing the data interface and transfer through assembly 10. By enclosing alternative modular inserts 13 with metalized modular housings 12, adjacent ports are insulated from each other and alien crosstalk is reduced from port-to-port.

Housing 12 can be described as defining a metallic cavity design. The metallic cavity design of housing 12 surrounds all the internal pairs associated with modular insert 13 to reduce the transmitted signals' electromagnetic radiation during transmission. By isolating each component in the interface system, the radiated noise from each port is individually controlled by coupling reduction. The initial benefit is the reduction of the internal signal EMI field because of the metallic shield's Shielded Effectiveness value (SE). The SE of the metallic material provides an effective barrier against internal, as well as external, noise sources. The metallic enclosure provides a shielded barrier against adjacent ports transmitting signal noises.

Figure 5:
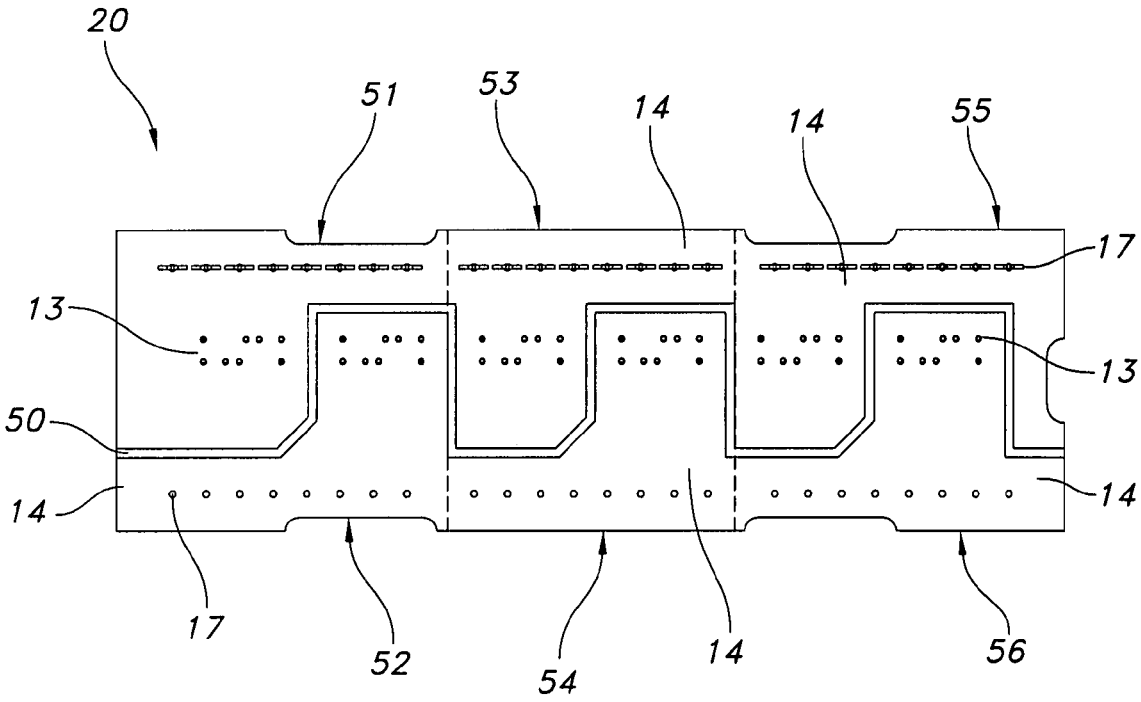
FIG. 5 is a schematic illustrating component configuration of an exemplary sub-assembly associated with the present disclosure.

FIG. 5 illustrates a schematic of an exemplary sub-assembly 20. In an exemplary embodiment, sub-assembly 20 includes six PCB sub-assemblies 51, 52, 53, 54, 55, and 56. Exemplary PCB assemblies include, but are not limited to a dual PCB design with 51, 53, and 55 combined on one board and 52, 54 and 56 on the other board and a single board with 51, 52, 53, 54, 55 and 56 combined on a single board. Each exemplary PCB sub-assembly associated with the present disclosure includes a PCB 14 having IDC pins 17 and a modular insert 13. The PCB sub-assemblies are arranged in a staggered configuration such that sub-assemblies 51, 53, and 55 are aligned on a top portion of sub-assembly 20 and sub-assemblies 52, 54, and 56 are aligned on a bottom portion of sub-assembly 20. In a staggered formation, IDC pins 17 of sub-assemblies 51, 53, and 55 will substantially align horizontally across the top portion of sub-assembly 20 and likewise, IDC pins 17 of sub-assemblies 52, 54, and 56 will substantially align horizontally across the bottom portion of sub-assembly 20. Modular inserts 13 of sub-assemblies 51, 52, 53, 54, 55, 56 will substantially horizontally align across a central portion of sub-assembly 20 in the exemplary staggered formation.

In a staggered configuration, PCB sub-assemblies 51, 53, and 55 may advantageously have similar (or identical) geometries. The geometries of sub-assemblies 51, 53, and 55 are typically different from the geometries of PCB sub-assemblies 52, 54, and 56, as shown in FIG. 5. The staggered configuration offers several advantages, such as maximizing limited space for traces and other associated electronic hardware. Sub-assembly 20 can further include a dielectric gap or spacer 50, creating a separation between top and bottom PCB sub-assemblies, e.g. a spacer 50 between PCB sub-assembly 51 and 53. Spacer 50 can be made of any dielectric material. In an exemplary embodiment, a multiport connector assembly can provide for a staggered PCB sub-assembly configuration with or without the metalized modular housings. Building a multiport connector assembly with individualized PCB sub-assemblies offers installation and maintenance advantages. For example, if one port fails, replacement of the entire PCB is not necessary since a user will only need to replace and/or fix the faulty PCB sub-assembly.

A staggered configuration of PCB sub-assemblies 20 allows for assembling a multiport assembly 10 that is typical in the industry and effective in reducing crosstalk noise. Previous IDC pin configurations, such as those described in U.S. patent application Ser. No. 11/119,116 by Aekins, the disclosure of which is incorporated by reference herein, placed IDC pins above and below the modular insert. A top/bottom IDC pin configured connector can be used in an alternative embodiment of an assembly associated with the present disclosure. As previously described, a metalized modular housing 12 will enclose alternating PCB's. Each PCB includes IDC pins and a modular insert.

In an alternative embodiment, a multiport assembly can be designed to have a stacked rather than staggered alignment. In a stacked configuration, one port, along with the associated PCB's, will align vertically directly above a second port. In a typical exemplary stacked configuration, only one PCB is used with the modular inserts aligned one on top of another in pairs of two. In an alternative exemplary stacked configuration, two PCB's are used with three modular inserts on a top positioned PCB lined up in a row and three modular inserts on a bottom positioned PCB lined up in a row. A multiport assembly associated with a stacked configuration may have six ports, three on a top row and three on a bottom row. Each port typically includes the features described above with respect to the disclosed staggered configuration. In an exemplary embodiment, a modular housing 12 encloses alternating modular inserts, thus isolating an enclosed modular insert from adjacent modular inserts.

Referring again to FIG. 5, each PCB sub-assembly 20 is adapted to snap securely into place when assembling assembly 10. A staggered horizontal alignment configuration of IDC pins and modular inserts offers significant installation advantages. Moreover, housing alternate modular inserts in a single multiport assembly 10 provides the end user with a single unit for purchasing. This reduces costs of manufacturing, assembly and installation. A typical IDC pin group will have eight IDC pins.

In an exemplary embodiment, assembly 10 further includes an IDC pin shield snapped into position on the outside of rear IDC housing 15. The IDC pin shield snaps onto IDC receptacles 18 and is metalized. Utilizing a metalized IDC shield adds further noise reduction and electrical isolation. In an exemplary embodiment, a single shield extending across more than one IDC pin group is used. In a further alternative embodiment, a plurality of IDC pin shields, each associated with an individual port's IDC pins is used.

The benefit of reducing connector transmitted signal EM noise is reduction in port-to-port near-end crosstalk or also called alien near-end crosstalk (ANEXT), that can be a problem in high speed networks such as 10 Gigabit Ethernet (10GBASE-T). Isolation can also be achieved by the addition of a high frequency impedance device EMI Inductive source between ports to provide a common ground reference.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed for carrying out this invention, but that the invention will include all embodiments falling within the scope of the appended claims.

The invention claimed is:

1. A multiport connector assembly comprising:

(a) a plurality of PCB sub-assemblies, each sub-assembly including: (i) at least one printed circuit board (PCB); (ii) a plurality of insulation displacement contact (IDC) pin groups having a plurality of IDC pins; and (iii) a modular insert;

(b) a front housing adapted to enclose the plurality of PCB sub-assemblies;

(c) a rear IDC housing having a plurality of IDC pin receptacles adapted to receive the IDC pins of the IDC pin groups; and (d) a plurality of metalized modular housings, wherein each modular housing encloses a non-adjacent modular insert and is floating relative to ground.

2. An assembly according to claim 1, wherein each modular insert associated with each of the plurality of PCB sub-assemblies: (i) is in electrical communication with the PCB and one of the plurality of IDC pin groups, and (ii) is adapted to receive a telecommunication connector plug.

3. An assembly according to claim 2, wherein the connector plug is a RJ plug.

4. An assembly according to claim 2, wherein the front housing defines a plurality of apertures wherein each aperture is adapted to receive a modular insert associated with one of the plurality of PCB sub-assemblies and allow for insertion of the telecommunication connector plug.

5. An assembly according to claim 4, wherein each aperture is sized to receive a RJ-45 plug.

6. An assembly according to claim 5, wherein the front housing is made of plastic.

7. An assembly according to claim 1, wherein each of the plurality of modular housings is formed of a metal.

8. An assembly according to claim 1, wherein each of the plurality of modular housings is formed of plastic and the plastic is at least partially plated with metal.

9. An assembly according to claim 1, further comprising an IDC pin shield coupled to the IDC pin groups.

10. An assembly according to claim 9, wherein the IDC pin shield is selectively metalized.

11. An assembly according to claim 1, wherein each modular housing encloses one modular insert in an alternating configuration, such that every other modular insert is enclosed within a modular housing and each modular insert is electrically isolated from an adjacent modular insert.

12. An assembly according to claim 11, wherein the front housing is adapted to receive the alternating configured modular housings.

13. A multiport connector assembly comprising:

(a) a plurality of printed circuit board (PCB) sub-assemblies wherein each sub-assembly includes: (i) a PCB; (ii) an insulation displacement contact (IDC) pin group having a plurality of IDC pins; and (iii) a modular insert;

(b) a front housing adapted to enclose the plurality of PCB sub-assemblies; a (c) a rear IDC housing having a plurality of IDC pin receptacles adapted to receive the IDC pins of the IDC pin groups; and (d) a plurality of metalized modular housings wherein each modular housing encloses a non-adjacent modular insert and is floating relative to ground;

wherein the plurality of PCB sub-assemblies are positioned in a cooperating geometric configuration.

14. An assembly according to claim 13, wherein the geometric configuration is a stacked configuration such that two modular inserts are substantially aligned one on top of the other.

15. An assembly according to claim 13, wherein the geometric configuration is a staggered configuration such that the modular inserts of each PCB sub-assembly substantially line up horizontally.

16. An assembly according to claim 15, wherein the plurality of PCB sub-assemblies includes two PCB sub-assemblies.

17. An assembly according to claim 15, wherein the plurality of PCB sub-assemblies includes six PCB sub-assemblies.

18. An assembly according to claim 13, further comprising a dielectric spacer material positioned between each of the plurality of PCB sub-assemblies.

19. An assembly according to claim 13, wherein each of the modular inserts of each of the PCB sub-assemblies: (i) is in electrical communication with the PCB and the IDC pin group associated with the corresponding PCB sub-assembly; and (ii) is adapted to receive a telecommunication connector plug.

20. An assembly according to claim 19, wherein the front housing defines a plurality of apertures and wherein each aperture is adapted to receive one of the plurality of the PCB sub-assemblies and allow for insertion of the telecommunication connector plug.

21. An assembly according to claim 13, wherein each of the plurality of modular housings is formed of a metal.

22. An assembly according to claim 13, wherein each of the plurality of modular housings is formed of plastic and the plastic is at least partially plated with metal.

23. An assembly according to claim 13, wherein each modular housing encloses one modular insert in an alternating configuration, such that every other modular insert is enclosed within a modular housing and each modular insert is electrically isolated from an adjacent modular insert.

24. A method of reducing crosstalk noise within a multiport connector assembly comprising:

(a) providing a plurality of printed circuit board (PCB) sub-assemblies, wherein each sub-assembly includes a PCB, an IDC pin group and a modular insert;

(b) enclosing non-adjacent modular inserts with a metalized modular insert housing; and (c) enclosing the plurality of sub-assemblies and metalized modular insert housings within a front housing and a rear IDC pin housing;

wherein each of the metalized modular insert housings is floating relative to ground; and wherein the PCB sub-assemblies are positioned in a cooperating geometric configuration.

25. A method according to claim 24, wherein enclosing the modular inserts with a modular insert housing electrically isolates one modular insert from an adjacent modular insert.

26. A method according to claim 24, wherein the front housing defines a plurality of apertures, wherein each aperture is adapted to receive the PCB sub-assembly and a telecommunication connector plug.

27. A method according to claim 24, wherein the rear IDC pin housing includes a plurality of IDC pin receptacles adapted to receive the IDC pin groups.

28. A method according to claim 24, wherein each of the PCB sub-assemblies are separated by a dielectric spacer material.

29. A method according to claim 24, wherein the geometric configuration is a staggered configuration, such that the modular inserts of each PCB sub-assembly substantially line up horizontally.

30. A method according to claim 24, wherein the geometric configuration is a stacked configuration, such that two modular inserts are substantially aligned one on top of the other.

* * * * *